US006059265A

United States Patent [19]

Moody

[11] Patent Number: 6,059,265

[45] Date of Patent: May 9, 2000

[54] ADJUSTABLE LIFTING AND PRECISION POSITIONING DEVICE

[75] Inventor: Paul E. Moody, Barrington, R.I.

[73] Assignee: The United States of America as represented by the Secretary of the Navy, Washington, D.C.

[21] Appl. No.: 08/954,885

[22] Filed: Oct. 7, 1997

[51] Int. Cl.[7] ..... B66D 1/00; B66C 1/66; B66C 1/10

[52] U.S. Cl. ..... 254/266; 294/67.5; 294/81.3

[58] Field of Search ..... 254/266, 81.3, 254/81.56, 67.5, 82.12

[56] References Cited

U.S. PATENT DOCUMENTS

| | | | |
|---|---|---|---|
| 2,237,427 | 4/1941 | Grau | 294/67.5 |
| 3,751,097 | 8/1973 | Jones et al. | 294/81.3 |
| 4,431,223 | 2/1984 | Miller | 294/67.5 |
| 4,936,616 | 6/1990 | Williams | 294/81.3 |
| 5,800,000 | 9/1998 | Shockley | 294/81.3 |

*Primary Examiner*—John M. Jillions
*Attorney, Agent, or Firm*—Michael J. McGowan; Prithvi C. Lall; James M. Kasischke

[57] ABSTRACT

A device for precision lifting and positioning of test pieces is provided. The device has a rigid connector attachment which moves the application point of a vertical lifting force over the center of gravity of a test piece despite having a lifting attachment point at its far edge. The rear to forward adjustment is provided by a screw which moves the application of the lifting force backward and forward along the axis of a rigid connector.

7 Claims, 5 Drawing Sheets

ADJUSTABLE LIFTING AND PRECISION POSITIONING DEVICE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1.) Field of the Invention

The present invention relates generally to devices for lifting and precision positioning of objects. Specifically, it is a device for positioning the lifting force directly over the lifted object's center of gravity and providing a means for rotating the device through slight displacements of the lift force from the object's center of gravity.

(2.) Description of the Prior Art

During testing of equipment at the Naval Undersea Warfare Center, it is often necessary to suspend a test piece within a test tank. To do this, the test piece must be inserted horizontally into the test tank. The means for lifting these heavy test pieces is situated above the tank, and is commonly attached to the test piece from above. However, as the test piece is slid into the mouth of the test tank, the center of gravity of the test piece moves inside the test tank. Thus, the lifting force cannot be applied directly along the center of gravity of the test piece throughout the operation. Instead, the only place where the lifting force can be applied is at the farthest horizontal edge of the test piece, which does not extend into the test tank during insertion. Because the lifting force is applied at a point which is displaced horizontally from the center of gravity, the application of this force creates a torque tending to rotate the test piece about its center of gravity, such rotation preventing the close-tolerance alignment which is required within the test tank. In order to compensate for this effect, the prior art has attached balancing weights which are suspended outward from the outermost edge of the test piece. These balancing weights shift the center of gravity of the test piece so that it corresponds to the edge along which the lifting force is applied.

However, the weight-attachment system has several drawbacks. First, the addition of balancing weights increases the total weight of the test piece, requiring higher capacity lifting devices. This problem can be alleviated to some degree by lengthening the arm where the balancing weight is applied; however, additional arm length brings about a second drawback. Often, the horizontal clearance to the side of the insertion point for the test tank is barely sufficient for the test piece. In which case, the arm of the balancing weight must be made extremely short. As the length of the balancing arm decreases, the amount of additional weight which must be applied to shift the center of gravity increases proportionately. For very short balancing arms, the balancing weights must be many times the weight of the original test piece. No prior art lifting devices exist which allow for precision lifting of test pieces without requiring the application of balancing weights as described.

SUMMARY OF THE INVENTION

Accordingly, it is an object of the present invention to provide a device for application of lifting forces along the center of gravity of a test piece when the only attachment point is at one edge of the test piece.

It is a further object of the present invention to provide this lifting force without requiring any balancing weights.

A still further object of the present invention is to provide for precision adjustment of the orientation of the test piece during lifting operations.

In accordance with these and other objects, the invention is a lifting and precision positioning device for attachment to one edge of a test piece and to a lifting means. The device is rigid and angled such that the point where the lifting force is applied is offset inwards from the edge of the test piece. The degree to which the lifting force is offset can be adjusted through the use of a screw adjuster to precisely match the center of gravity of the test piece. The adjuster also provides rotational capability, thus allowing precision alignment of the test piece.

BRIEF DESCRIPTION OF THE DRAWINGS

The foregoing objects and other advantages of the present invention will be more fully understood from the following detailed description and reference to the appended drawings wherein.

DESCRIPTION OF THE PREFERRED EMBODIMENTS

Figure 1:
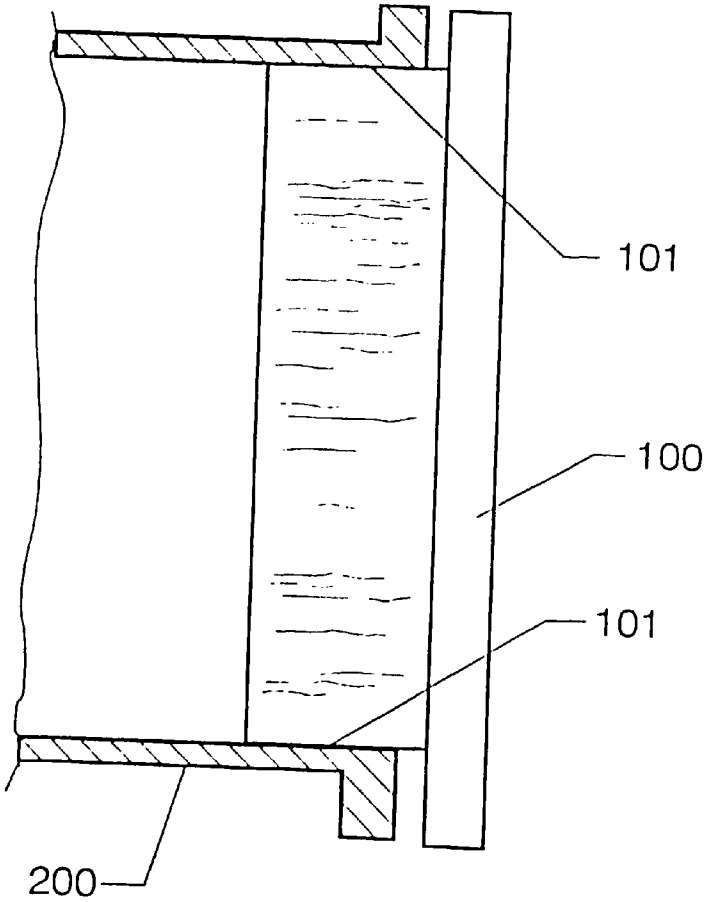
FIG. 1 is a depiction of the insertion of the unmodified test piece within the tank.

Referring now to the drawings, and in particular to FIG. 1, a depiction of the insertion of test piece 100 into tank 200 is shown. The size of test piece 100 is such that test piece 100 must be precisely aligned with tank 200 before insertion can occur. If test piece 100 is not precisely aligned, the edges 101 of test piece 100 will bind against the edges of tank 200 thereby preventing insertion.

Figure 2A:
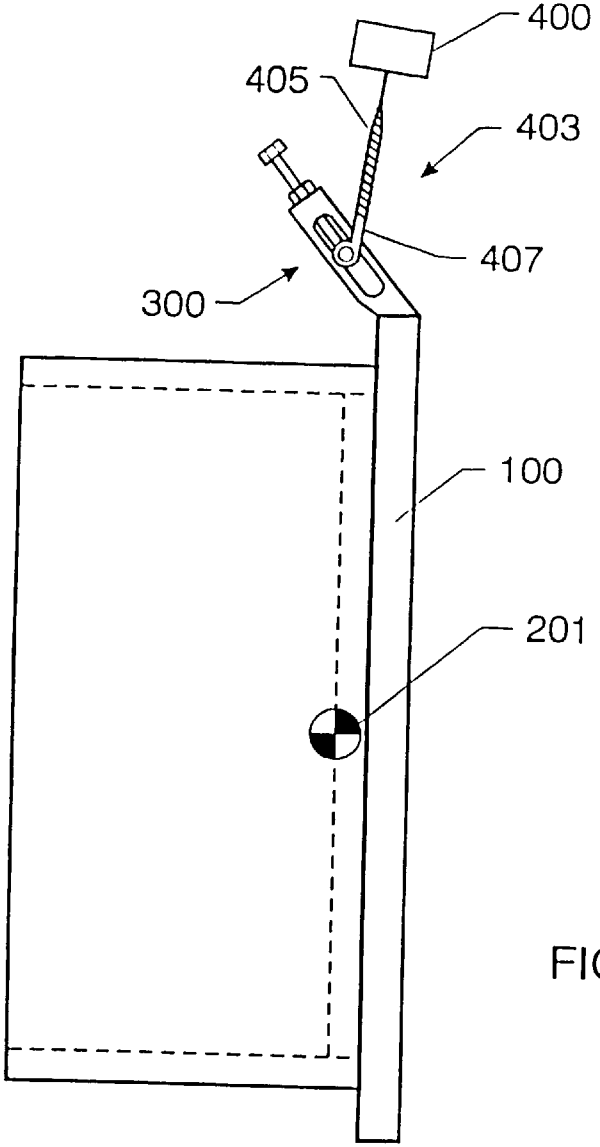
FIG. 2*a* is a side view of the test piece with the present invention attached.

Referring now to FIG. 2*a*, a side view of test piece 100 with the lifting and precision positioning device 300 attached is shown. Lifting connector 300 is rigidly attached to the upper lip of test piece 100. This attachment can be accomplished through permanent means including welding or bolting, or through a temporary bonding means. Lifting joint 403 attaches to a rigid lifting connector 300 having a topmost end away from the test piece and a bottom end for attachment to the test piece. Lifting joint 403 includes cord 405 connected to clevis 407 at one end. The other end of cord 405 is attached to lifting means 400, usually a winch or other device capable of exerting vertical force. The vertical force exerted is applied to a cable by lifting means 400 to cord 405 and clevis 407. Clevis 407 transmits the force to the rigid lifting connector 300, and thus through to test piece 100. As shown, the lifting device 300 can be adjusted to locate the lifting force over the center of gravity 201 of the test piece.

Figure 2B:
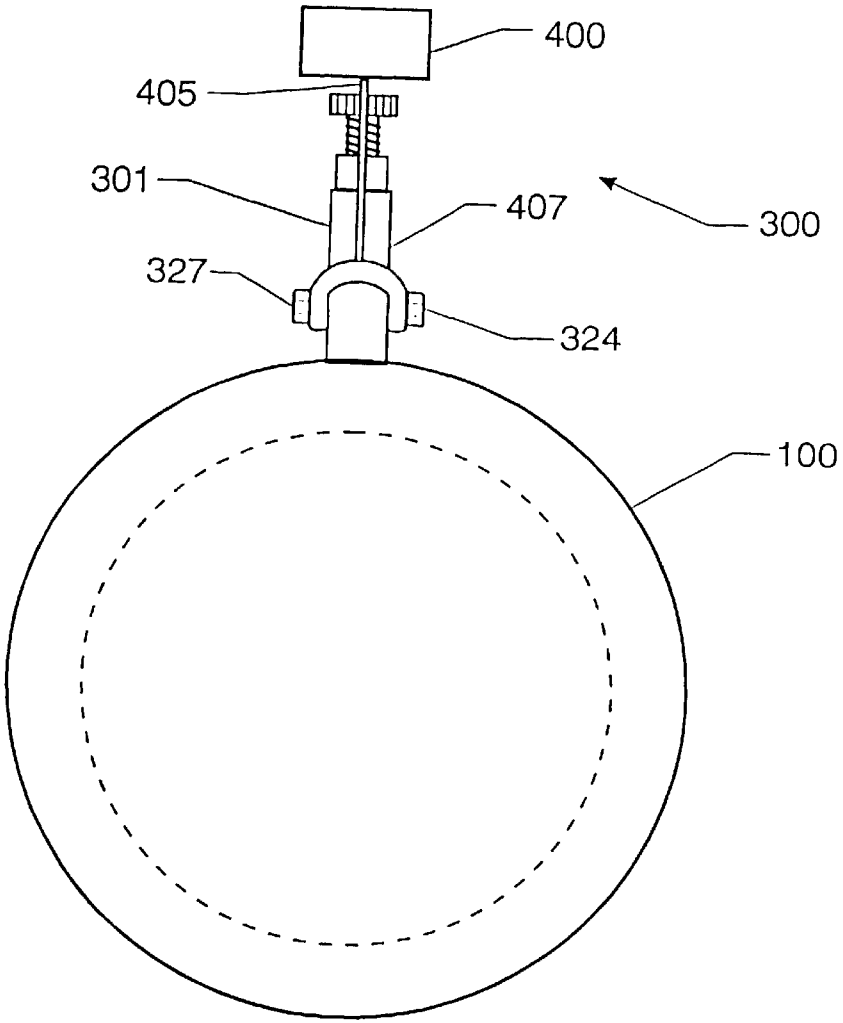
FIG. 2*b* is a front view of the test piece with the present invention attached.

Referring now to FIG. 2*b*, a front view of test piece 100 with the present invention attached is shown. Lifting connector 300 is attached to a position located approximately vertically above the center of gravity line for the test piece. When the lifting force is precisely aligned with the center of gravity, that is, when the attachment point of lifting connector 300 to test piece 100 is such that clevis 407 is directly above the center of gravity of test piece 100, then the torque generated when lifting test piece 100 is minimized. No weights or counter-balances are required to prevent rotation of test piece 100. In the preferred embodiment, lifting means 400 connects through cord 405 and clevis 407 to lifting connector 300. Clevis 407 is attached to lifting connector 300 by locked rod bolt 324 and rod tightening nut 327. Locked rod bolt 324 passes through rigid arm 301, securing lifting connector 300 to clevis 407.

Figure 3A:
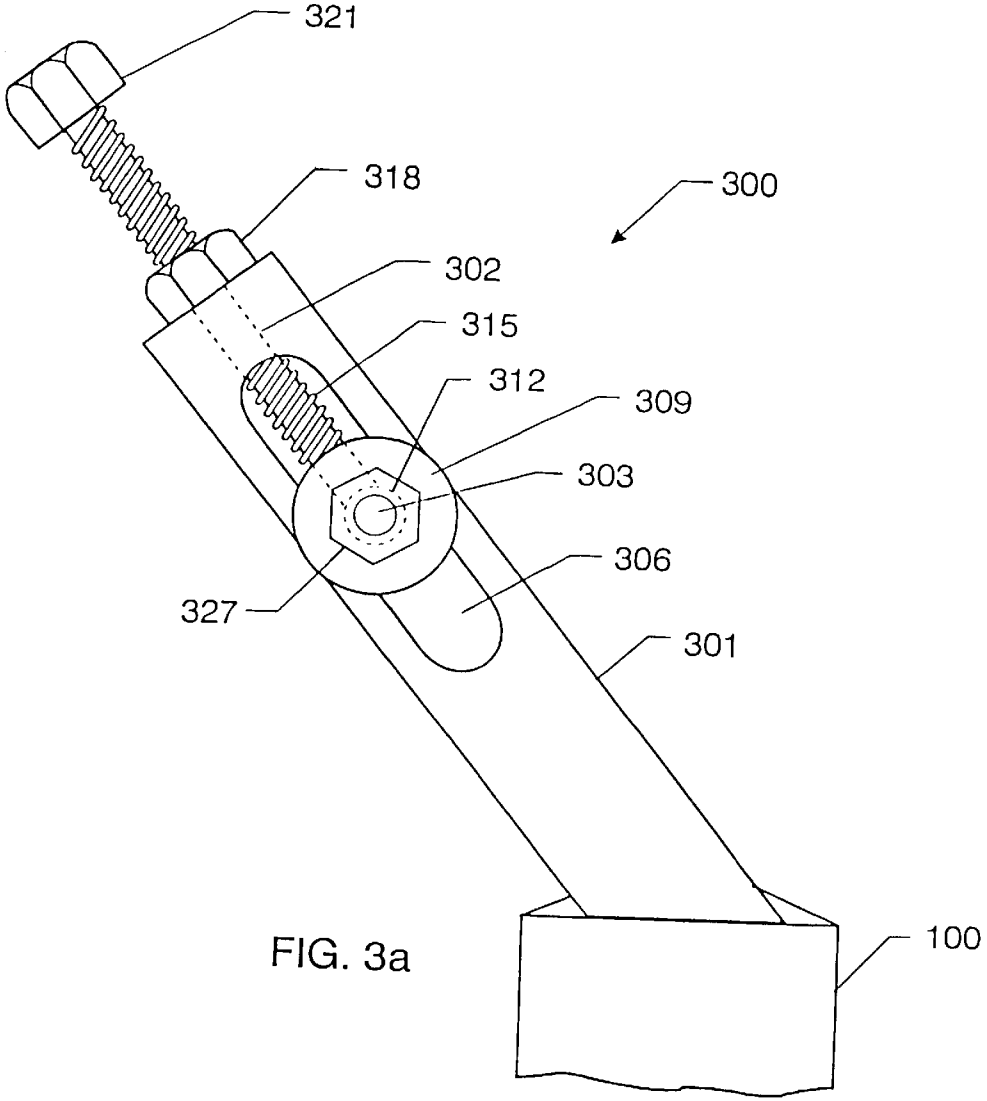
FIG. 3*a* is a detailed side view of the attachment component of the present invention.
Figure 3B:
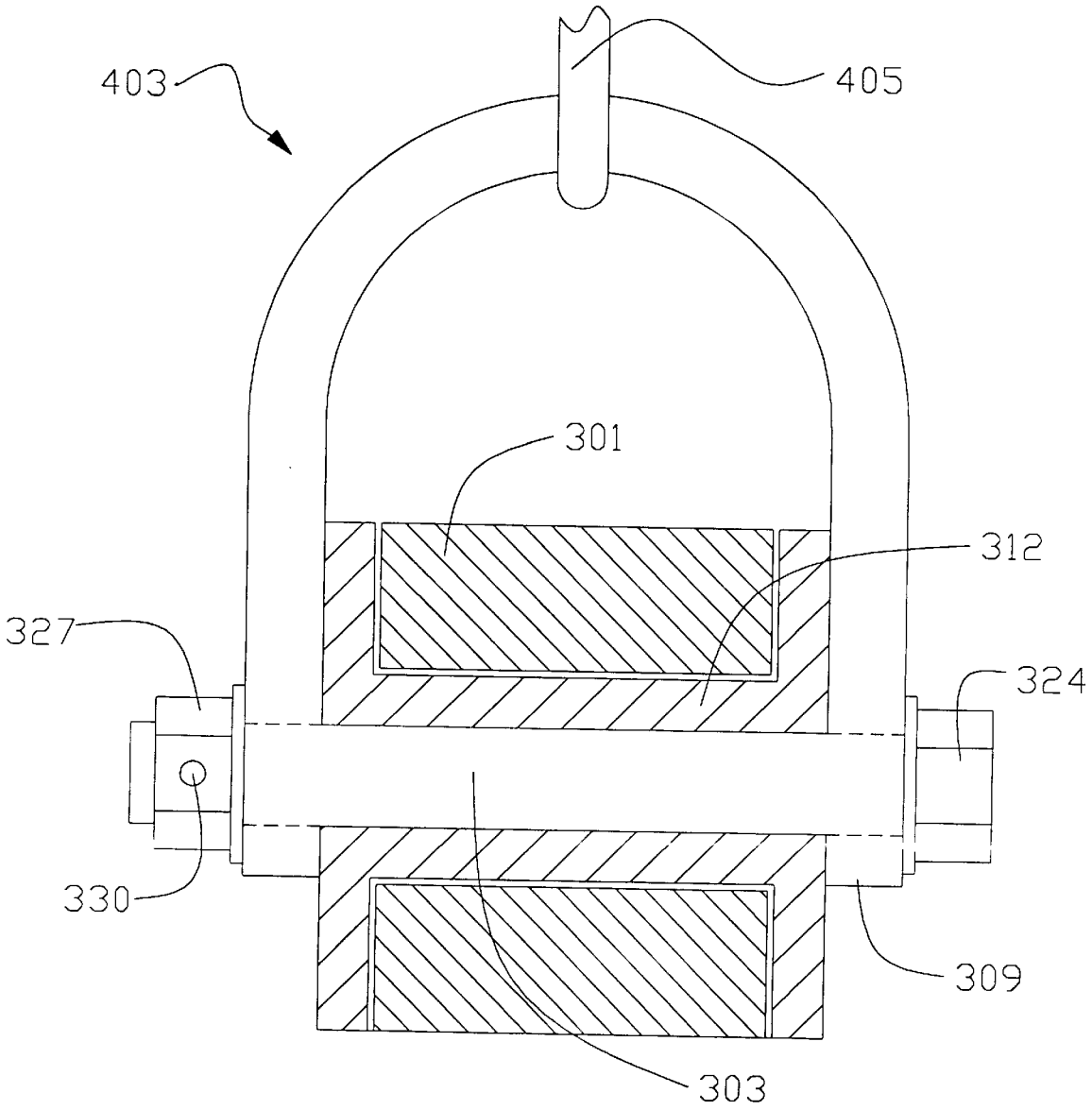
FIG. 3*b* is a detailed cross-sectional view of the attachment component of the present invention.

Referring now to FIG. 3*a* and FIG. 3*b*, a side and cross-sectional view, respectively of the attachment means for the lifting device and of the system for adjusting the application of the lifting force from front to rear is depicted. Lifting connector 300 is a rigid arm 301 having a threaded core 302 in its upper end. Lifting arm 301 is rigidly attached to test piece 100 as previously disclosed. A slot 306 is provided in lifting arm 301 in communication with threaded core 302. Slot 306 is an open slot passing through lifting arm 301 and extending longitudinally. The length of slot 306 determines the degree to which the lifting force can be adjusted in the front-to-rear direction. Lifting rod 303 passes through the center of slot 306, orthogonal to the centerline of lifting arm 301, and protrudes on either side of slot 306. Lifting rod 303 is surrounded by bushing shaft 312. Bushing shaft 312 is rigidly connected to bushing shoulders 309 at each end. Bushing shoulders 309 are positioned external to rigid arm 301 on either side of slot 306. Bushing shoulders 309 are substantially larger in circumference than both bushing shaft 312 and lifting rod 303 and serve the purpose of preventing cocking of bushing shaft 312 and lifting rod 303 in place within rigid arm 301.

Locked rod bolt 324 is rigidly attached to lifting rod 303 on one end. The lifting rod 303 is threaded, and rod tightening nut 327 is threaded onto the opposite end of lifting rod 303. Clevis 407 attaches around lifting rod 303 and is held in place by rod tightening nut 327. Once clevis 407 has been locked in the desired place, pin 330 may be inserted to lock rod tightening nut 327 in place. Adjustment screw 315 is displaced within rigid arm 301 and threaded into threaded core 302, with one end extending out of rigid arm 301. Locking nut 318 holds adjustment screw 315 rigidly in place within threaded core 302. Bolt head 321 terminates adjustment screw 315.

During lifting operation, vertical force is applied on lifting joint 403 and through its rigid connection to lifting rod 303. Lifting rod 303 slides upwards along slot 306 until bushing shaft 312 comes into contact with adjustment screw 315. By turning bolt head 321, and increasing or decreasing the penetration of adjustment screw 315 into threaded core 302, the position of lifting rod 303 within rigid arm 301 can be changed. As the relative position of lifting rod 303 changes, the point at which the vertical force is being applied moves either forward (when adjustment screw 315 is retracted) or backward (when adjustment screw 315 is advanced). When the vertical force is applied behind the center of gravity of test piece 100, test piece 100 will tend to tilt forward. Conversely, when the vertical force is applied in front of the center of gravity, test piece 100 will tilt backwards. Thus, the operator, through advancement or retraction of adjustment screw 315 can align the lifting force precisely with the center of gravity of test piece 100 and effect accurate and precise rotational positioning of test piece 100 relative to tank 200.

In the preferred embodiment of the present invention, lifting arm 301 is a solid square cross-section, steel rod. It can be made from any similar inflexible metal or alloy. However, it is to be understood that the present invention will work equally well using hollow or semi-hollow rods of different shapes and dimensions and that it may be made of other inflexible materials. The requirement that lifting arm 301 be substantially rigid is important because any deformation of lifting arm 301 would affect the axis along which the lifting force is being applied.

It will be further understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A device for lifting and precision positioning of a test piece comprising:

a vertical lifting means for exerting a vertical lifting force;

a rigid lifting connector having a longitudinal slot formed therethrough, a centerline running the length of said connector, a topmost end away from said test piece and a bottom end for attaching to said test piece and having position adjusting means for adjusting the position of said lifting rod in said longitudinal slot, said position adjusting means further comprising:

a bushing shaft having bushing shoulders displaced around the ends of said bushing shaft, said bushing shaft positioned in said longitudinal slot such that said lifting rod passes through said bushing shaft;

an adjustment screw having a top end away from said rigid lifting connector and a bottom end within said rigid lifting connector, said adjustment screw being threaded within said rigid lifting connector and displaced along the centerline of said rigid lifting connector said bottom end contacting said bushing shaft upon lifting said lifting rod;

a locking nut attached to said adjustment screw and locked against the topmost end of said rigid lifting connector;

a bolt head rigidly attached to the topmost end of said adjustment screw; and a lifting rod displaced through said longitudinal slot and orthogonal to the centerline of said connector, said lifting rod being attached to said vertical lifting means.

2. The device of claim 1 wherein said position adjusting means comprises an adjustment screw threaded into said rigid lifting connector and having one end in physical contact with said lifting rod.

3. The device of claim 1 wherein said rigid lifting connector further comprises a tilting means for tilting the attached test piece, without moving the position of said vertical lifting means enclosed within said rigid lifting connector.

4. The device of claim 3 wherein said tilting means comprises an adjustment screw threaded into said rigid lifting connector and having one end in physical contact with said lifting rod.

5. The device of claim 1 wherein said vertical force exerting means further comprises:

a clevis joined to said lifting rod;

a cord rigidly attached to said clevis; and a tension applying means attached to said cord.

6. The device of claim 5 wherein said cable tension applying means is a winch.

7. A device for lifting and precision positioning of a test piece comprising:

a tension applying means;

a cable attached to said tension applying means;

a clevis rigidly attached to said cable;

a rigid lifting connector having a longitudinal slot formed therethrough, a centerline running the length of said connector, a threaded core is formed along the centerline at the top of said rigid lifting connector in communication with said longitudinal slot, said connector being capable of attaching to the test piece;

a lifting rod displaced through said longitudinal slot and orthogonal to the centerline of said connector, said lifting rod being attached to said clevis;

a bushing shaft positioned in said longitudinal slot such that said lifting rod passes through said bushing shaft;

bushing shoulders displaced about the ends of said bushing shaft outside said longitudinal slot;

an adjustment screw positioned in said rigid lifting connector threaded aperture, said adjustment screw being capable of limiting movement of said bushing shaft within said longitudinal slot;

a locking nut attached to said adjustment screw and locked against the topmost end of said rigid lifting connector; and a bolt head rigidly attached to the top end of said adjustment screw.

* * * * *